US005251529A

United States Patent [19]

Burgett

[11] Patent Number: 5,251,529

[45] Date of Patent: Oct. 12, 1993

[54] SOLENOID MOUNTING SYSTEM FOR A KEYBOARD INSTRUMENT

[76] Inventor: Kirk Burgett, 3504 Barrington, Sacramento, Calif. 95864

[21] Appl. No.: 856,513

[22] Filed: Mar. 24, 1992

[51] Int. Cl.[5] ..... G10C 3/12

[52] U.S. Cl. ..... 84/423 R; 84/246

[58] Field of Search ..... 84/17, 18, 20, 22, 107, 84/111-113, 246, 423 R; 211/94; 248/500

[56] References Cited

U.S. PATENT DOCUMENTS

| | | | |
|---|---|---|---|
| 3,426,304 | 10/1966 | Cannon et al. | 84/107 X |
| 3,581,254 | 5/1971 | Cannon | 84/107 X |
| 3,581,255 | 5/1971 | Cannon | 84/107 X |
| 4,031,796 | 6/1977 | Wilkes | 84/20 |
| 4,121,491 | 10/1978 | Wilkes | 84/20 |
| 4,513,652 | 4/1985 | Muramatsu et al. | 84/20 |

*Primary Examiner*—Michael L. Gellner
*Assistant Examiner*—P. Stanzione
*Attorney, Agent, or Firm*—James M. Ritchey

[57] ABSTRACT

A solenoid mounting system for attaching keyboard striking solenoid assemblies to a keyboard musical instrument is disclosed. Provided is a mounting rail having a top border, a bottom border, a front mounting rail surface, a back mounting rail surface, and two opposing end borders. Adjustably clamped to the top and bottom borders of the mounting rail are solenoid assemblies. The rail and associated solenoid assemblies are adjustably secured to the instrument proximate the keyboard.

13 Claims, 5 Drawing Sheets

SOLENOID MOUNTING SYSTEM FOR A KEYBOARD INSTRUMENT

BACKGROUND OF THE INVENTION

1. Field of the Invention

A mounting or attachment system for securing key striking solenoid assemblies to a keyboard musical instrument is presented. More particularly, the present invention relates to a solenoid mounting system having an adjustable mounting means for attaching to the keyboard instrument a plurality of improved solenoid key striking assemblies. The mounting system has a generally flattened, rectangular mounting rail having two opposing longitudinal, wedge-like edges. Each solenoid assembly has means for adjustably pinching or clamping onto one of the wedge-like edges of the mounting rail. Further, means are provided for maneuverably anchoring the mounting rail to a portion of the keyboard instrument.

2. Description of the Background Art

Existing systems with attachment means for securing solenoid assemblies to a keyboard instrument have included elements that are often cumbersome to mount or adjust, too large for use in the narrow spaces near many keyboards, or, when small enough to fit within a cramped keyboard space, deliver a weak striking force to the associated keys.

U.S. Pat. No. 4,031,796 describes a solenoid mounting assembly for musical keyboards. The disclosed assembly has parallel locking slots that run the length of the rail's longitudinal borders. To secure the solenoids, a protruding rib with opposing grooves cooperates with the locking slots. Each of the locking slots has means for threadably receiving a threaded fastener member. This slot element of the invention requires that the locking slot be deep enough to accept securely the threaded fastener. Therefore, as the drawings clearly indicate, each locking slot is "X" shaped so that a fastener can protrude through the threadable locking means. By necessity, this design requires that the thickness of the rail be of appropriate dimensions to accommodate the protruding fastener. As indicated above, the available leeway for positioning solenoids is often severely restricted near a keyboard. The minimum rail thickness required by this design inherently limits the structural locations in which the device will fit.

Disclosed in U.S. Pat. No. 4,121,491 is a solenoid mounting rail for a musical keyboard instrument that is very similar to the rail detailed in U.S. Pat. No. 4,031,796. The exhibited invention has two critical differences from that described in the above U.S. Pat. No. 4,031,796 solenoid mounting rail. First, alignment rib on the longitudinal edges of the planar surfaces of the rail have been added. These alignment ribs project outward from the surface of the rail and accept solenoid edges for mounting alignment. Second, the grooved rib for cooperatively holding the solenoids has been replaced by a locking slot like those disclosed in U.S. Pat. No. 4,031,796. As with the U.S. Pat. No. 4,031,796 mounting rail, this version must have an appropriate rail thickness to accommodate the locking nuts and the associated fastener, thereby limiting its use in narrow spaces.

U.S. Pat. No. 4,513,652 presents, for illustrative purposes, one possible type of solenoid actuator for keyboard instruments. This disclosure stresses the desirability of producing components that are small in size in order to fit within the restricted available space near a keyboard.

SUMMARY OF THE INVENTION

The object of the present invention is to provide an ingenious solenoid mounting unit or system, having an improved solenoid-to-rail mounting means that allows for the production of a solenoid mounting unit that is slender and will easily fit within the narrow spaces often associated with keyboard musical instruments.

Another object of the present invention is to produce a solenoid mounting system for keyboard instruments that allows for easy and reliable solenoid positioning and adjustment.

An additional object of the present invention is to supply a solenoid mounting system that permits ready positional adjustments between each solenoid assembly and the supporting mounting rail and between the mounting rail and the anchor point on the instrument.

A further object of the present invention is to furnish a solenoid mounting system for keyboard instruments that has a mounting rail that enhances the magnetic field of each solenoid and, therefore, the key striking force of each attached solenoid.

Yet an additional object of the present invention in to produce a solenoid mounting system that is efficiently constructed from inexpensive materials by uncomplicated methods.

According to this invention, there is provided a solenoid mounting system for use proximate a keyboard on a keyboard musical instruments comprising a mounting rail having a top border and a bottom border, a front mounting rail surface, a back mounting rail surface, two opposing end borders, a top lip proximate the top border, a bottom lip proximate the bottom border, wherein the top and bottom lips project outward past the back mounting rail surface, a top clamping channel in the back rail surface proximate the top lip, and a bottom clamping channel in the back rail surface proximate the bottom lip. Included in the subject system is a solenoid assembly having an invertable supporting frame for clamping over either the top border or the bottom border. Means are associated with the supporting frame for clamping the solenoid assembly to the mounting rail proximate either the top or the bottom border. Also, means are provided on the back mounting rail surface, proximate the top and bottom borders, for cooperating with the frame clamping means for fastening the solenoid assembly to the mounting rail. Additionally, means are incorporated in the subject device for adjustably securing the rail to the keyboard instrument.

Other objects, advantages, and novel features of the present invention will become apparent from the detailed description that follows, when considered in conjunction with the associated drawings.

DESCRIPTION OF THE PREFERRED EMBODIMENT

Figure 1:
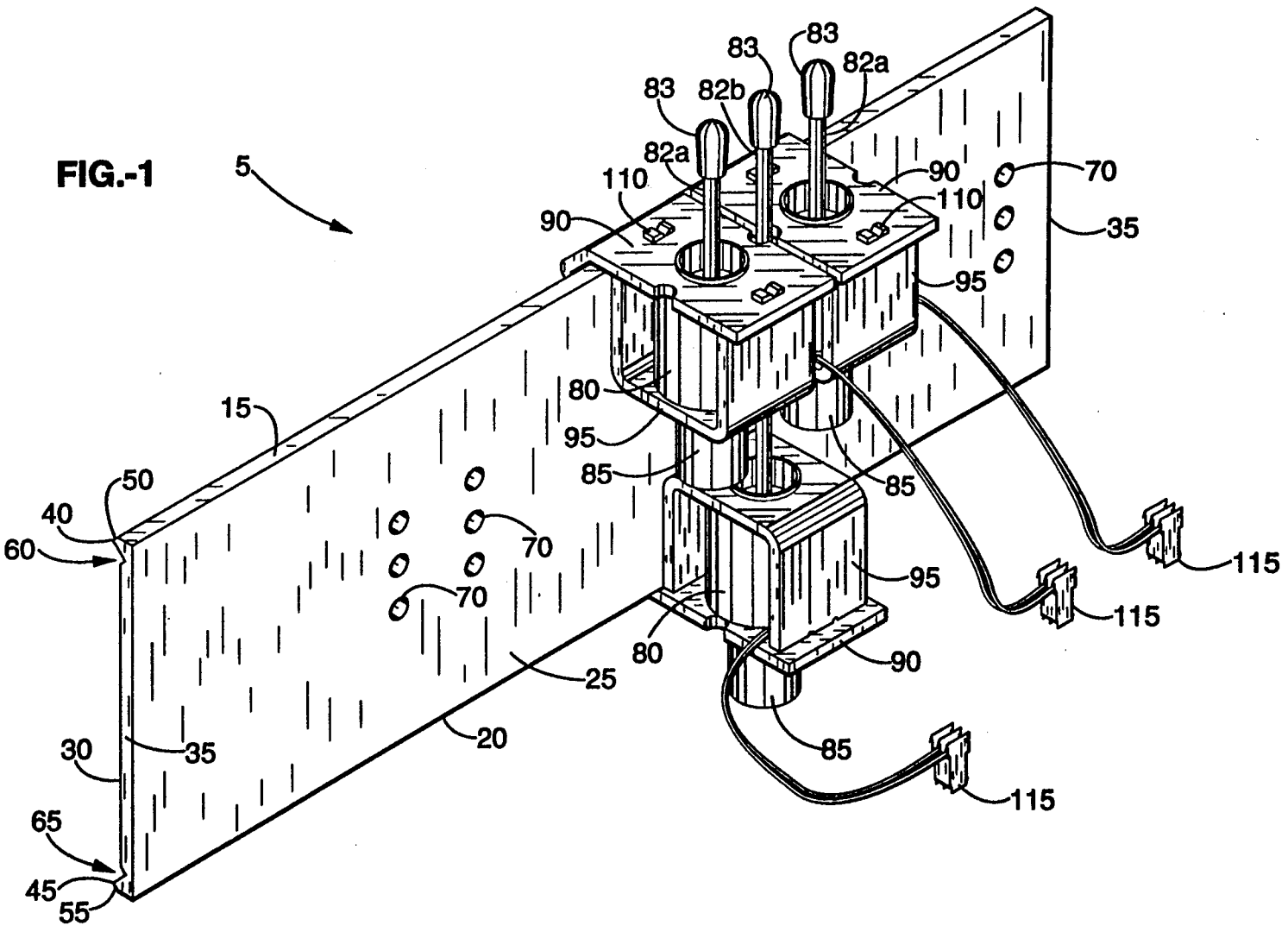
FIG. 1 is a perspective view of the subject apparatus.
Figure 2:
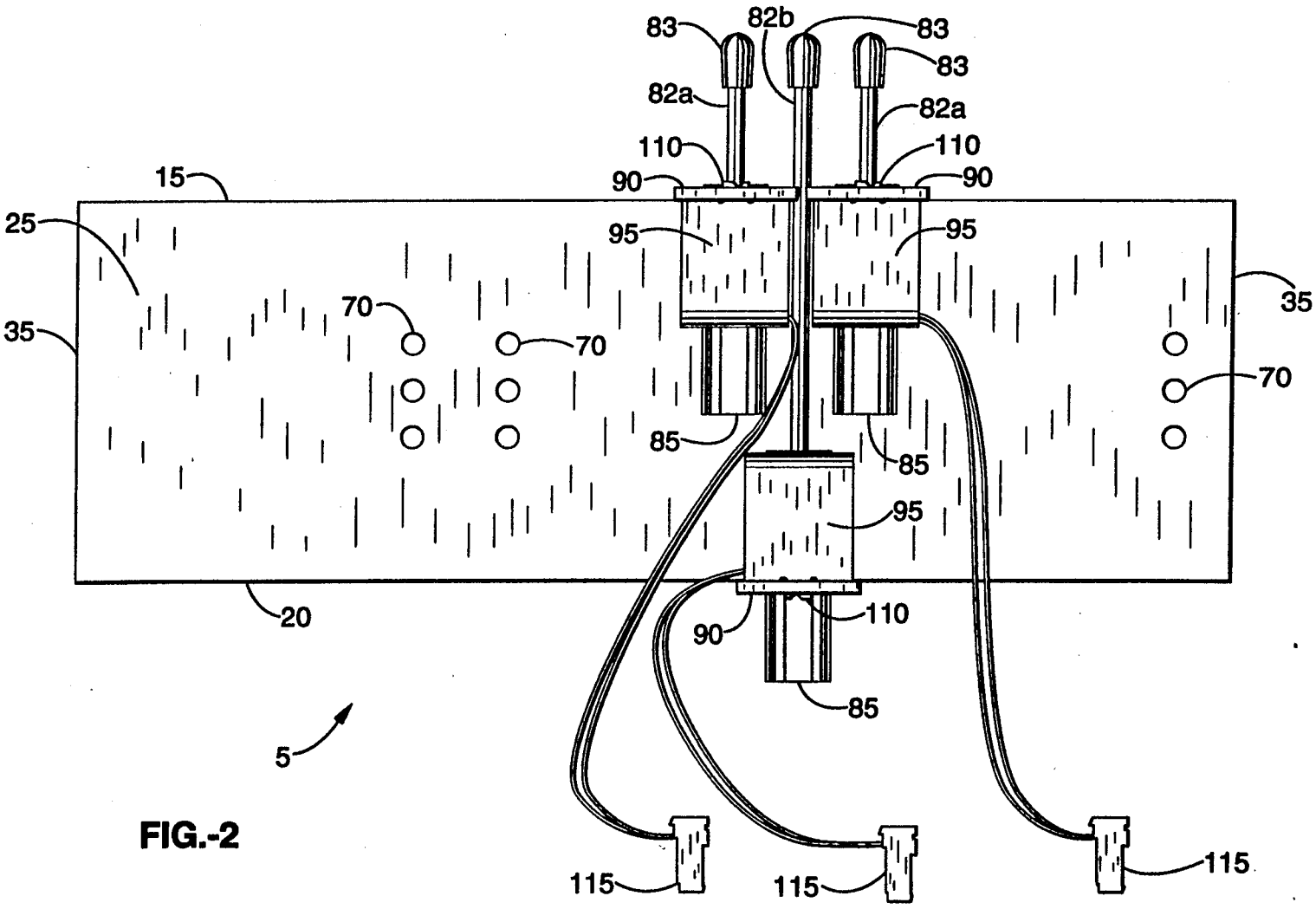
FIG. 2 is a front view of the subject apparatus.
Figure 3:
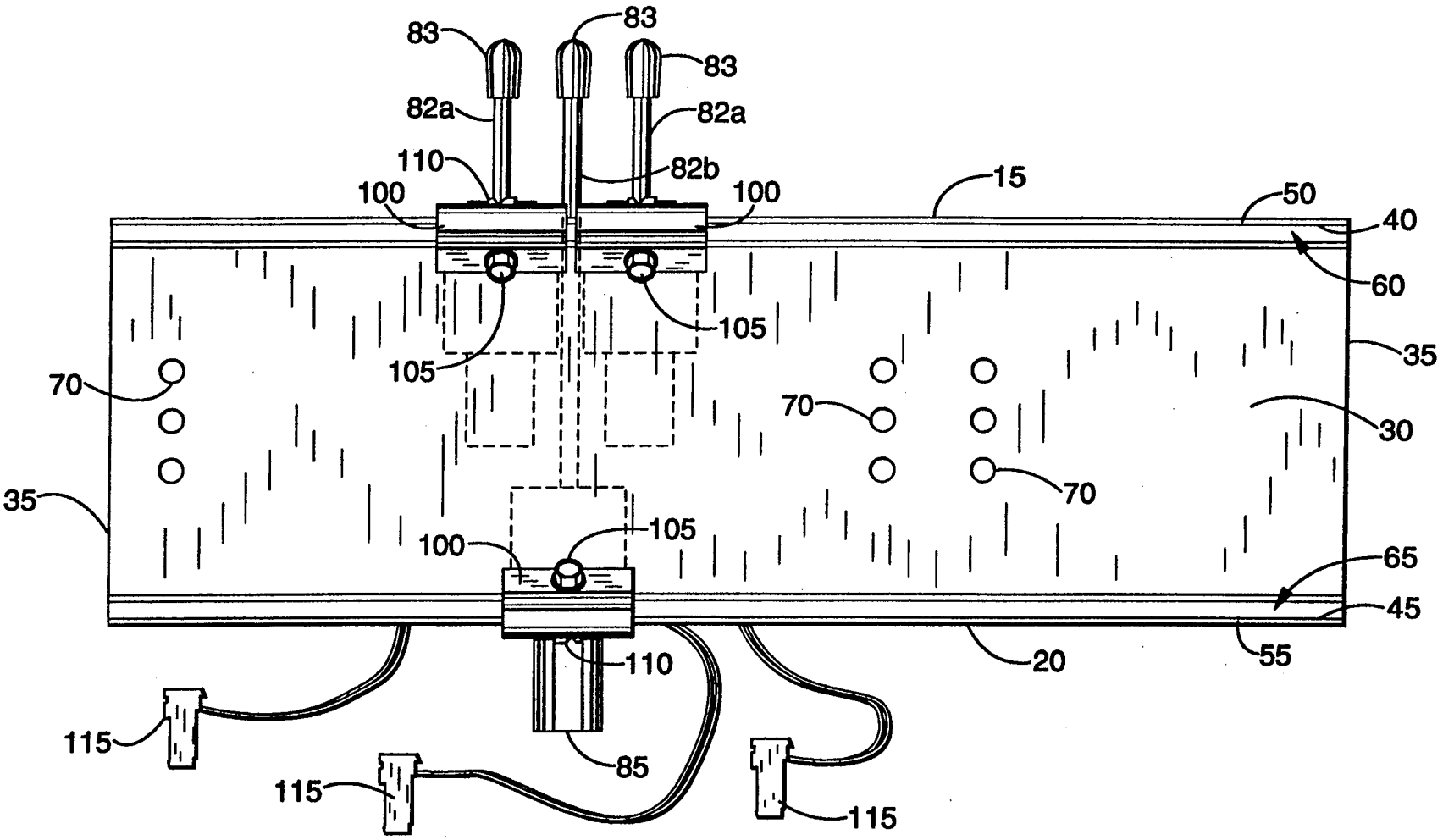
FIG. 3 is a back view of the subject apparatus.
Figure 4:
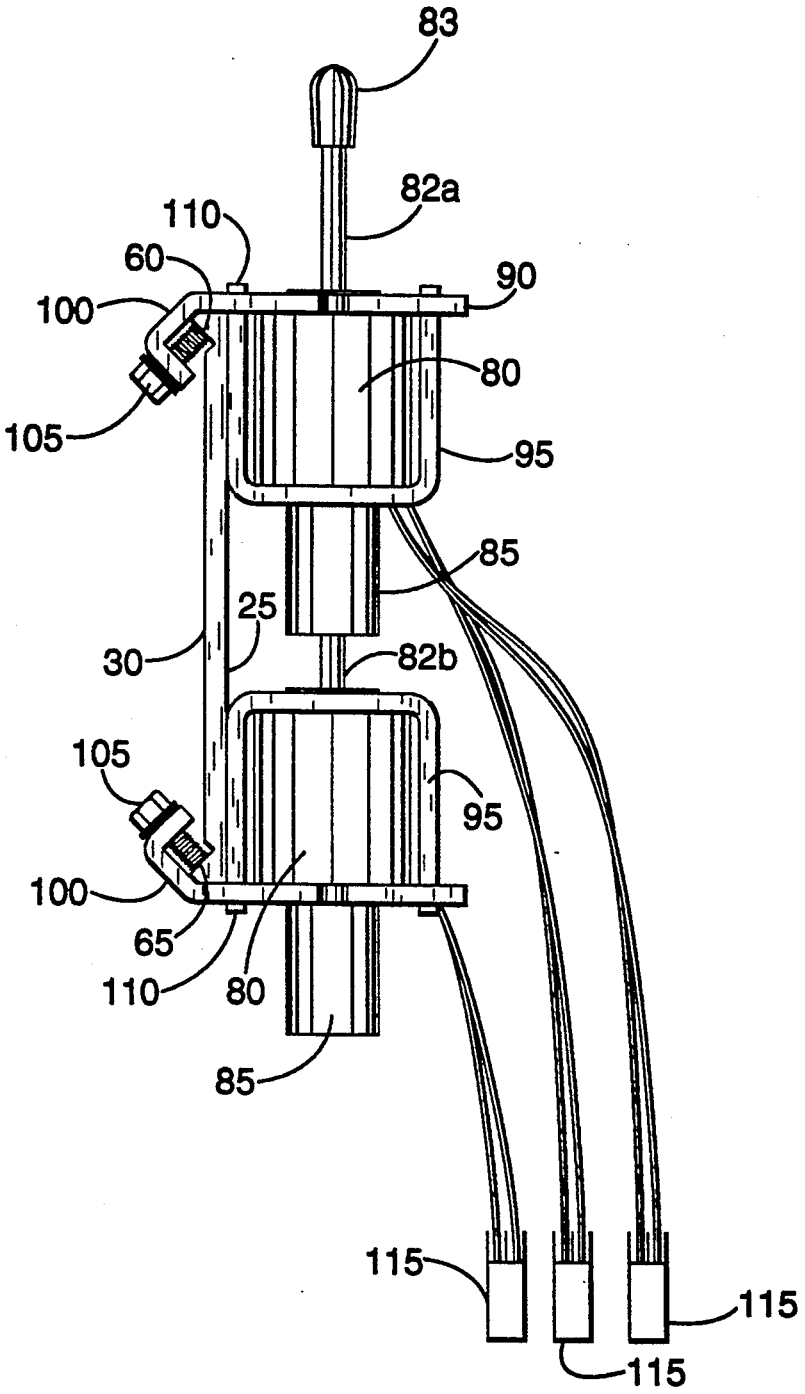
FIG. 4 is a side view of the subject apparatus.
Figure 6:
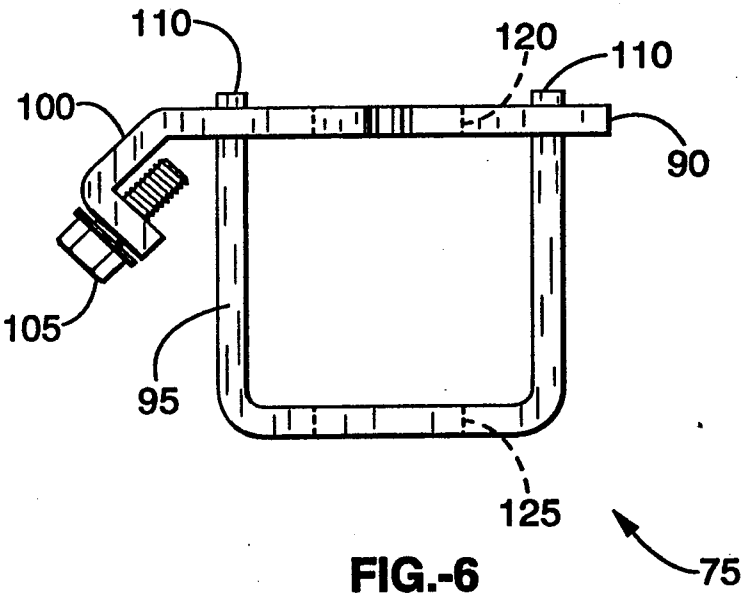
FIG. 6 is a side view of the subject solenoid assembly.
Figure 5:
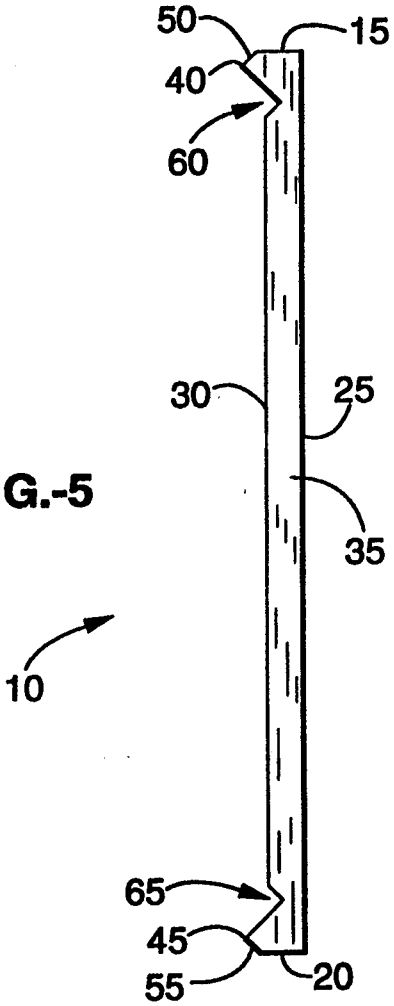
FIG. 5 is a side view of the subject mounting rail.

Referring now to FIGS. 1-6, there is disclosed a preferred embodiment of a solenoid mounting system 5 of the subject invention. This device is for securing solenoid key striking assemblies in a keyboard musical instrument. Keyboard musical instruments may have each key actuated by a solenoid delivered force. Player pianos, organs, synthesizers, and similar instruments may have manual or automation enhancements that employ solenoids to strike appropriate keys. In order that a high longitudinal mounting density for solenoids is achieved in the preferred embodiment of the subject invention, two usually parallel,alternating rows of solenoid assemblies are secured to a mounting rail 10.

The subject system, as illustrated in particular in FIGS. 1–4, comprises a generally flattened, rectangular solenoid mounting rail 10 (shown alone in FIG. 5 as a side view) having a top 15 and bottom 20 longitudinal borders with a proximal or front mounting rail surface 25, a distal or back mounting rail surface 30, and two opposing end borders 35. The dimensions of the rail 10 are adjusted to permit its insertion within an instrument, proximate the keyboard. Since the rail 10 is relatively thin, most keyboard instruments easily receive the rail 10 in a position suitable for use in striking the keys with the associated solenoids.

As a portion of the rail's 10 solenoid attachment means, proximate each longitudinal border 15 and 20 is a top lip 40 and a bottom lip 45, respectively. Each lip 40 and 45 is generally coextensive with each longitudinal border 15 and 20 (i.e., lip 40 follows proximate border 15 and lip 45 follows proximate border 20). Although other equivalent configuration are within the realm of this disclosure, usually, the lips 40 and 45 project outward past the back mounting rail surface 30. Even though not critical to the nature of the subject device, generally, each lip 40 and 45 terminates in a beveled or angled top surface 50 and bottom surface 55, respectively.

Extending proximate and displaced inwardly from each border 15 and 20 are clamping channels 60 and 65, respectively. Each channel 60 and 65 extents between the two opposing end borders 35. As will be evident from the following description concerning the solenoid assemblies, the clamping channels 60 and 65 cooperate with means from each solenoid assembly for adjustably securing each assembly to the rail's 10 top 15 or bottom 20 border.

Installation of the subject apparatus 5 within a keyboard instrument comprises attaching the solenoid mounting rail 10 to a suitable instrument support via mounting rail apertures 70. Conveniently positioned throughout the rail 10 are apertures 70 having dimensions suitable for receiving support fasteners such as screws, bolts, and similar devices. Given the variability of supports found in different keyboard instruments, the plurality of apertures 70 permits a user a wide latitude of installation configurations and adjustments.

Although the preferred device attaches on a customarily elongated, planar surface of an appropriate instrument, it is envisioned that curved instrument surfaces may be encountered and the device so adapted. Usually, rigid materials are employed to produce the rail 10, preferably aluminum, steel, or other like metals and metal alloys. Although not preferred, natural or synthetic polymers and similar materials may find use in creating the rail 10. Methods of fabricating the rail 10 such as pressing, rolling, extruding, milling, molding, and similar procedures are contemplated by this disclosure.

As depicted in FIGS. 1–4, adjustably secured over each border 15 and 20 of the mounting rail 10 are solenoid assemblies. Each solenoid assembly is adjusted along the rail 10 to position it beneath the key to be struck by that assembly's activation. Since the available space near the keys is limited, by having staggered rows of solenoid assemblies a sufficient number of assemblies are compacted into the given space to strike every key in the keyboard. Each solenoid assembly comprises a solenoid mounting or supporting frame 75 (seen in side view in FIG. 6) and a solenoid having an electromagnet magnet 80 (usually cylindrical), a top border plunger **82*a* or a bottom border plunger 82*b*, a resilient plunger bumper 83, and a plunger housing 85**. To strike with a plunger a specific key in the instrument, with a particular force and for a desired duration to generate the selected sound, an electronic signal is sent to the magnet of the solenoid assembly located proximate the key. Upon termination of the signal the plunger returns to a rest position.

A particularly useful and cost limiting feature of the subject invention is the ability of using the same solenoid supporting frame 75 on either the top 15 or bottom 20 rail borders. The solenoid supporting frame 75 is reversible and is mounted either, as shown in FIGS. 1–4 and specifically in FIG. 6, on the top border 15 or on the bottom border 20, as shown in FIGS. 1–4. Although other equivalent forms are contemplated to be within the realm of this disclosure, preferably, the solenoid frame 75 comprises a rail attachment member 90 and an associated or partially surrounding support or cowling 95. Usually the cowling 95 has a U-shaped configuration.

Incorporated into each solenoid supporting frame 75 are means for adjustably clamping each solenoid assembly to the mounting rail 10, proximate either the top 15 or bottom 20 borders. Preferably, the clamping means comprises a channel hook 100 that wraps over the top 15 or bottom 20 borders and a threaded anchoring member 105 having first and second ends, such as a bolt, screw or similar device, that adjustably secures each assembly to the top channel 60 or bottom channel 65. When a solenoid assembly is mounted on the front mounting rail surface 25, the hook 100 projects from the supporting frame past the top 15 border or bottom border and terminates proximate a channel 60 or 65. After appropriate rotation of the second end of the anchoring member 105, the first end of the member 105 presses into the channel 60 or 65 and secures the assembly from movement. Member 105 is loosened to adjust an assembly's position along the rail 10. Therefore, the channels 60 and 65 cooperate with the assembly hooks 100 and bolts 105 to create solenoid mounting system having the required solenoid assemblies adjustably positioned along the length of the rail 10.

The solenoid cowling 95 folds around the magnet 80 and including the rail attachment member 90 forms a surrounding partial enclosure for the magnet 80. Although other equivalent means, such as welding, brazing, and the like, are contemplated, usually, the cowling 95 is attached to the rail attachment member 90 by means of clips or inserts 110 that fit through receiving apertures in the rail attachment member 90 and are deformed to secure the two (rail attachment member 90 and cowling 95) together.

As noted above, within each solenoid assembly is an electromagnet 80. Extending from each magnet 80 is a striking signal coupling means, preferably, electrical conductors that terminate in suitable couplers 115. As with solenoids in general, surrounded by the electromagnet 80 is one end of an elongated plunger. Each plunger has a narrow diameter end for striking a key and a thicker diameter end that responds to the electromagnetic field in the magnet 80. To compensate for the distance differences due to rail 10 attachment locations, the top border plungers 82*a* have a shorter length than the bottom border plungers 82*b*. When the electromagnet 80 is not producing a magnetic field, a lower portion of the plunger 82*a* or 82*b* fits within a plunger housing 85. The housing 85 attaches to either the rail attachment member 90 (when in an assembly for mounting on the bottom border 20) or the cowling 95 (when in an assembly for mounting on the top border 15). To accommodate the plunger and the plunger housing 85 an aperture 120 is formed in the rail attachment member 90 and an aperture 125 is formed in the cowling 95 (see FIG. 6). Within each housing 85 is a spring for absorbing the force of a returning plunger 82*a* or 82*b*.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A solenoid mounting system for use with a keyboard musical instrument proximate a keyboard, comprising:

a) a mounting rail having a top border, a bottom border, a front mounting rail surface, a back mounting rail surface, and two opposing end borders;

b) a solenoid assembly having a supporting frame;

c) means associated with said supporting frame for clamping said solenoid assembly to said mounting rail proximate either said top or said bottom border, wherein said supporting frame clamping means comprises a hook, wherein when said solenoid assembly is mounted on said front mounting rail surface said hook projects from said supporting frame past said top border or said bottom border and terminates proximate said fastening cooperation means; and d) means associated with said mounting rail, proximate said top and said bottom borders, for cooperating with said frame clamping means for fastening said solenoid assembly to said mounting rail.

2. A solenoid mounting system according to claim 1, wherein said fastening cooperation means comprises a clamping channel formed in said back mounting rail surface.

3. A solenoid mounting system according to claim 2, wherein said clamping channel extends between said two opposing end borders, proximate said top and said bottom borders.

4. A solenoid mounting system according to claim 1, wherein said hook further comprises means for adjustably anchoring said solenoid assembly to said mounting rail.

5. A solenoid mounting system according to claim 2, wherein said hook further comprises a threaded anchoring member having a first and a second end, wherein said anchoring member first end contacts said clamping channel when said second end is appropriately rotated thereby adjustably anchoring said solenoid assembly to said mounting rail.

6. A solenoid mounting system for use with a keyboard musical instrument proximate a keyboard, comprising:

a) a mounting rail having a top border and a bottom border, a front mounting rail surface, a back mounting rail surface, two opposing end borders, a top lip proximate said top border, a bottom lip proximate said bottom border, wherein said top and bottom lips project outward past said back mounting rail surface, a top clamping channel in said back rail surface proximate said top lip, and a bottom clamping channel in said back rail surface proximate said bottom lip;

b) a solenoid assembly having an invertable supporting frame for clamping over either said top border or said bottom border;

c) means associated with said supporting frame for clamping said solenoid assembly to said mounting rail proximate either said top or said bottom border;

d) means associated with said mounting rail, proximate said top and said bottom borders, for cooperating with said frame clamping means for fastening said solenoid assembly to said mounting rail; and e) means incorporated into said mounting rail for adjustably securing said rail to said keyboard instrument.

7. A solenoid mounting system according to claim 6, wherein said supporting frame clamping means comprises a hook, wherein when said solenoid assembly is mounted of said front mounting rail surface said hook projects from said supporting frame past said top border or said bottom border and terminates proximate said fastening cooperation means.

8. A solenoid mounting system according to claim 7, wherein said hook further comprises means for adjustably anchoring said solenoid assembly to said mounting rail.

9. A solenoid mounting system according to claim 6, wherein said fastening cooperation means comprises a clamping channel formed in said back mounting rail surface.

10. A solenoid mounting system according to claim 9, wherein said clamping channel extends between said two opposing end borders, proximate said top and said bottom borders.

11. A solenoid mounting system according to claim 9, wherein said hook further comprises a threaded anchoring member having a first and a second end, wherein said anchoring member first end contacts said clamping channel when said second end is appropriately rotated thereby adjustably anchoring said solenoid assembly to said mounting rail.

12. A solenoid mounting system according to claim 6, wherein said solenoid assembly further comprises;

a) a cylindrical electromagnet secured within said frame;

b) an elongated plunger which is responsive to a magnetic field generated in said electromagnet;

c) a resilient plunger bumper secured to said plunger and d) a plunger housing secured to said supporting frame for surrounding a portion of said plunger.

13. A solenoid mounting system according to claim 6, wherein said adjustable rail securing means comprises a mounting rail having a plurality of apertures with each said aperture piercing said mounting rail, wherein a engaging member passes through said aperture to grip said keyboard instrument.

* * * * *